US005158013A

United States Patent [19]

Morris

[11] Patent Number: 5,158,013

[45] Date of Patent: Oct. 27, 1992

[54] CAN FLATTENING APPARATUS

[76] Inventor: Drew W. Morris, P.O. Box 10111, Greenville, S.C. 29603

[21] Appl. No.: 746,859

[22] Filed: Aug. 19, 1991

[51] Int. Cl.[5] ..... B30B 15/30; B30B 9/32

[52] U.S. Cl. ..... 100/45; 100/99; 100/137; 100/233; 100/902

[58] Field of Search ..... 100/45, 99, 137, 215, 100/216, 233, 902

[56] References Cited

U.S. PATENT DOCUMENTS

| | | | |
|---|---|---|---|
| 192,300 | 6/1877 | Smith | 100/233 |
| 2,816,502 | 12/1957 | Eismann | 100/233 X |
| 3,299,802 | 1/1967 | Black, Jr. | 100/233 |
| 4,265,170 | 5/1981 | Schulze, Jr. | 100/215 X |
| 4,291,618 | 9/1981 | Heiser et al. | 100/902 X |
| 4,358,994 | 11/1982 | Talley | 100/45 |

FOREIGN PATENT DOCUMENTS

| | | | |
|---|---|---|---|
| 2109962 | 9/1972 | Fed. Rep. of Germany | 100/233 |
| 58-23598 | 2/1983 | Japan | 100/902 |
| 59-67000 | 4/1984 | Japan | 100/902 |
| 59-88000 | 5/1984 | Japan | 100/902 |
| 2011302 | 7/1979 | United Kingdom | 100/902 |

*Primary Examiner*—Harvey C. Hornsby
*Assistant Examiner*—Stephen F. Gerrity
*Attorney, Agent, or Firm*—Bailey & Hardaway

[57] ABSTRACT

A novel can flattening apparatus and process is provided comprising a generally rectangular housing having side walls and a front compaction plate with the housing defining an entrance opening and an exit opening, a pivot rod extending through the housing, a pair of arms fixedly attached to the pivot rod and having rollers attached at the opposite ends thereof, a flattener plate disposed within the housing and being pivotally attached to the housing such that the flattener plate can fit flush against the front compaction plate, a structure for crimping the middle of a can mounted to the top of the flattener plate, a captive plate mounted to the structure for crimping the middle of a can.

7 Claims, 2 Drawing Sheets

CAN FLATTENING APPARATUS

BACKGROUND OF THE INVENTION

This invention relates generally to the art of crushing, and more particularly to the art of can crushing for space and environmental conservation.

Various devices exist within the prior art for crushing articles including such devices as garbage compactors and devices for garbage trucks. Other devices, however, are directed to crushing cans, and various can crushing devices exist within the prior art. With the emphasis that has evolved with respect to the environment, especially littering and recycling, there has been an increased need for can crushing devices. There are various such devices designed to crush aluminum cans so that the cans may be easily collected for recycling.

Despite some of the can crushing devices within the prior art functioning well for their intended purposes, much room for improvement exists.

SUMMARY OF THE INVENTION

It is thus an object of this invention to provide a novel can flattening apparatus and process.

It is a further object of this invention to provide such a novel can flattening apparatus and process which can easily be used to flatten a can placed therein.

These as well as other objects are accomplished by a can flattening apparatus comprising a generally rectangular housing having side walls and a front compaction plate, with the housing defining an entrance opening at the top and an exit opening at the bottom. A pivot rod extends through the housing and is fixedly secured to the side walls. A pair of arms is fixedly attached to the pivot rod with rollers attached at the opposite ends thereof. A flattener plate is disposed in the housing and is pivotally attached to the housing such that the flattener plate fits flush against the front compaction plate. Crimping means are mounted to the top of the flattener plate and a captive plate is fixedly mounted to the crimping means for crimping the middle of a can, with the captive plate and the fastener plate defining an area therebetween in which rollers of the arms are positioned. Means for rotating the pivot rod are also included with the can flattening apparatus.

DETAILED DESCRIPTION

In accordance with this invention it has been found that a novel can flattening apparatus and process can be provided. It has also been found that the can flattening apparatus and process can easily be used to flatten a can placed therein.

According to this invention, a can is inserted into the apparatus and is crimped along its middle so that the ends of the can become inturned. The can is then allowed to drop further through the can flattening apparatus to a point where it is flattened as a whole, forcing the inturned ends of the can to abut one another. The can is then allowed to exit the can flattening apparatus in this flattened condition.

Figures 1, 2, 3, 4, 5:
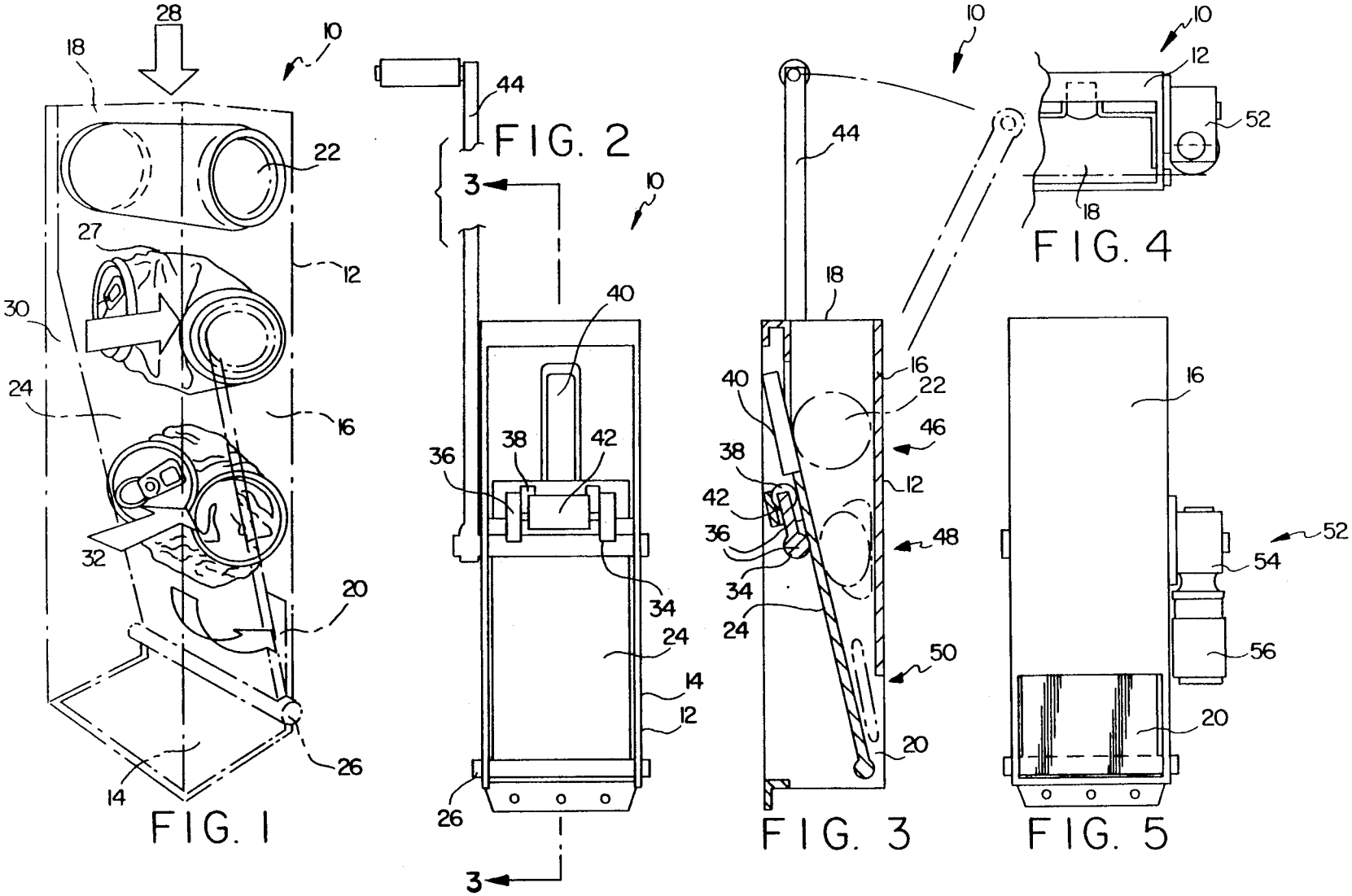
FIG. 1 is a schematic diagram in partial phantom of the operation of the can flattening apparatus.
FIG. 2 is a rear elevation view of the can flattening apparatus.
FIG. 3 is a cross sectional view of the can flattening apparatus along the line 3-3 of FIG. 2.
FIG. 4 is a partial plan view of the can flattening apparatus.
FIG. 5 is a front elevation view of the can flattening apparatus.

FIG. 1 of the drawings is a schematic diagram in partial phantom of the operation of the can flattening apparatus 10. Can flattening apparatus 10 comprises a generally rectangular housing 12 having side walls 14 and a front compaction plate 16, seen in partial phantom in FIG. 1. Housing 12 defines an entrance opening 18 at the top and an exit opening 20 at the bottom. A can such as can 22 is inserted into entrance opening 18 for flattening and for subsequent exit from housing 12 through exit opening 20.

A flattener plate 24 is disposed within housing 12 and pivotally attached to housing 12 by pivot 26 such that flattener plate 24 fits flush against front compaction plate 16 of housing 12.

The sequence of flattening a can 22 in can flattening apparatus 10 begins by inserting can 22 through entrance opening 18 (arrow 28). At arrow 30 can 22 is held in place between front compaction plate 16 and crimping means 40 of flattener plate 24. The middle of can 22 is then crimped by crimping means 40, as indicated by arrow 30. By crimping the middle of can 22, the ends of can 22 become inturned and form a crimp line 27 in the middle of can 22. Upon repositioning flattener plate 24 to its original position, crimped can 22 drops to flattening position. Flattener plate 24 is then forced against front compaction plate 16 thereby flattening can 22 and forcing the inturned ends of can 22 to abut one another adjacent the crimp line 27, this step being indicated by arrow 32. It is seen that when can 22 leaves the crimping position, the subsequent can assumes the crimping position and is crimped as can 22 is flattened. Now being flattened, can 22 then leaves housing 12 by dropping through exit opening 20.

The structure of can flattening apparatus 10 is better seen in FIG. 2, which is a rear elevation view of can flattening apparatus 10. Can flattening apparatus 10 is thus seen as comprising a generally rectangular housing 12 having side walls 14. Flattener plate 24 is disposed within housing 12, being pivotally attached to housing 12 by pivot 26 such that flattener plate 24 can fit flush against front compaction plate 16 (seen in FIG. 3). A pivot rod 34 extends through housing 12 and is fixedly secured to side walls 14. A pair of arms 36 are fixedly attached to pivot rod 34 and have rollers 38 attached to arms 36 opposite pivot rod 34. Crimping means 40 is mounted to the top of flattener plate 24 and comprises a square tube. A captive plate 42 is fixedly mounted to flattener plate 24, with captive plate 42 being in a position parallel to and facing flattener plate 24. Captive plate 42 and flattener plate 24 thereby define an area therebetween in which rollers 38 of arms 36 are positioned. Can flattening apparatus 10 also comprises means for rotating pivot rod 34, illustrated as operating handle 44.

FIG. 3 is a cross sectional view of can flattening apparatus 10 along the line 3-3 of FIG. 2 and better illustrates the flattening can 22. With can 22 positioned within housing 12, pivot rod 34 is rotated by means for rotating pivot rod 34, shown in a preferred embodiment as operating handle 44. Rotating pivot rod 34 causes rotation of arms 36 and rollers 38 which are positioned between captive plate 42 and flattener plate 24, to force flattener plate 24 towards front compaction plate 16. Crimping means 40 also is forced towards front compaction plate 16 since middle crusher 40 is mounted to the top of flattener plate 24.

With can 22 positioned between middle crusher 40 and front compaction plate 16, as indicated at arrow 46, can 22 is ready for rotation of pivot rod 34 to cause crimping means 40 to crimp the middle of can 22 forcing the ends of can 22 to become inturned. Using operating handle 44 to rotate pivot rod 34 in a reverse direction allows can 22 to drop further within housing 12 thereby positioning can 22 to be flattened as a whole by a subsequent rotation of pivot rod 34, as indicated by arrow 48. By using handle 44 to rotate pivot rod 34 a third time, flattener plate 24 is forced away from front compaction plate 16 thus allowing can 22, which is now flattened, to drop between front compaction plate 16 and flattener plate 24 and out of housing 12 through exit opening 20, as indicated by arrow 50.

FIG. 4 is a partial plan view of can flattening apparatus 10. As illustrated, entrance opening 18 is defined by housing 12 and is adapted to receive a can therein. FIG. 4 illustrates that a gear head and motor option 52 may be used with can, flattening apparatus 10 instead of handle 44 as a means for rotating pivot rod 34.

FIG. 5 is a front elevation view of can flattening apparatus 10 also illustrating the embodiment of can flattening apparatus 10 which utilizes a gear head and motor option 52. This gear head and motor option 52 comprises a gear box 54 and a motor 56 which provides the means for rotating pivot rod 34 in this embodiment. Also illustrated in FIG. 5 is exit opening 20 which is defined at the bottom of front compaction plate 16.

Figure 6:
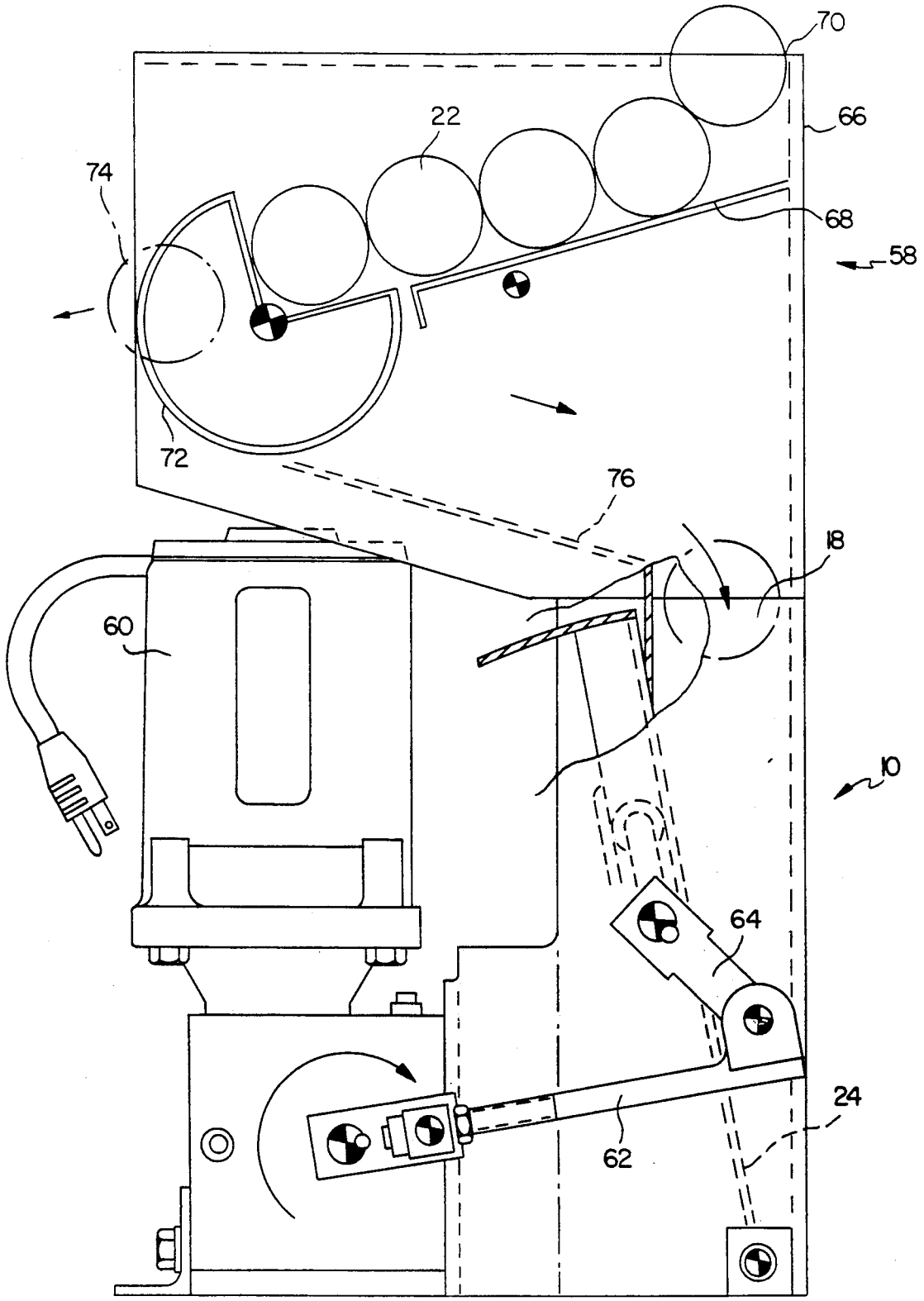
FIG. 6 is a side elevation view in partial phantom of the can flattening apparatus having a tray feeder thereon.

FIG. 6 is a side elevation view in partial phantom of can flattening apparatus 10 having a tray feeder 58 thereon. This embodiment of can flattening apparatus 10 also utilizes an electrical motor 60 which comprises a set of pivotally attached lever arms 62 which are connected to a second lever arm 64. Second lever arm 64 is attached to pivot rod 34 (FIGS. 2 and 3) of can flattening apparatus 10. Operation of motor 60 rotates lever arms 62 and second lever 64 thereby causing pivot rod 34 of can flattening apparatus 10 to rotate and force flattener plate 24 to move within can flattening apparatus 10.

The embodiment of can flattening apparatus 10 with tray feeder 58 thereon shown in FIG. 6 is intended to make consecutive flattening of a series of cans 22 possible and simple, although only one can 22 can be flattened at a time. Tray feeder 58 comprises a container 66 for holding cans 22. A tray 68 is positioned within container 66 and has a high end which slants downward to allow cans 22 to roll thereon. As shown in FIG. 6, container 66 defines an opening 70 in which cans 22 may be inserted. Cans 22 then roll down tray 68 and into director mechanism 72, which is adapted to receive one can at a time. Means for determining the weight of a can, such as a scale, may be included in can flattening apparatus 10. Such means may be separate from director mechanism 72 or may be incorporated with director mechanism 72. If such means detects a can over a predetermined weight, it triggers director mechanism 72 to rotate 90 degrees counterclockwise to discard the can, such as can 74. If no overweight can is detected, director mechanism 72 is triggered to rotate 90 degrees clockwise to direct the can along the inner surface 76 of tray feeder 58 and into entrance opening 18 of can flattening apparatus 10. Director mechanism 72 then rotates back to its original position and receives another can. When flattening of the previously fed can is completed, director mechanism 72 is triggered and then rotates to guide another can to can flattening apparatus 10. With tray feeder 58 combined with motor 60, this preferred embodiment of can flattening apparatus 10 enables many cans to be easily and rapidly flattened in a consecutive and uniform manner.

It is thus seen that the present invention provides a novel can flattening apparatus and process. It is also seen that the present invention provides such a novel can flattening apparatus and process which can easily be used to crush a can placed therein. Many variations are apparent to those of skill in the art, and such variations are embodied within the spirit and scope of the present invention as measured by the following appended claims.

That which is claimed:

1. A can flattening apparatus comprising:

a generally rectangular housing having side walls and a front compaction plate, said housing defining an entrance opening at the top and an exit opening at the bottom;

a pivot rod extending through said housing fixedly secured to said side walls;

a pair of arms fixedly attached to said pivot rod and having rollers attached at opposite ends thereof;

a flattener plate disposed in said housing, said flattener plate being pivotally attached to said housing such that said flattener plate can fit flush against said front compaction plate of said housing;

means for crimping the middle of a can mounted to the top of said flattener plate within said housing;

a captive plate fixedly mounted in a spaced relationship to said flattener plate, said captive plate being in a position parallel to and facing said flattener plate;

said captive plate and said flattener plate thereby defining an area therebetween in which said rollers of said arms are positioned; and means for rotating said pivot rod.

2. The can flattening apparatus according to claim 1 wherein said means for crimping the middle of a can comprises a square tube extending toward said entrance opening of said housing.

3. The can flattening apparatus according to claim 1 wherein said means for rotating said pivot rod comprises an operating handle secured to said pivot rod on the exterior of one of said side walls of said housing.

4. The can flattening apparatus according to claim 1 wherein said means for rotating said pivot rod comprises a motor and a gearbox.

5. The can flattening apparatus according to claim 1 further including a tray feeder comprising;

a container for holding cans;

a tray in said container, said tray having a high end slanting toward a low end;

an inner surface defined by said container, said inner surface slanting toward said entrance opening of the can flattening apparatus; and a director mechanism positioned adjacent said low end of said tray and above said inner surface, said director mechanism defining an area for receiving a can and being rotable whereby said can may be discarded by said director mechanism or guided to said inner surface of said container.

6. The tray feeder according to claim 5 wherein said director mechanism includes means for detecting a can over a predetermined weight so that a can above such a predetermined weight can be discarded.

7. A can flattening apparatus comprising:

a generally rectangular housing having side walls and a front compaction plate, said housing defining an entrance opening at the top and an exit opening at the bottom;

a pivot rod extending through said housing fixedly secured to said side walls;

a pair of arms fixedly attached to said pivot rod and having rollers attached at the opposite ends thereof;

a flattener plate disposed in said housing, said flattener plate being pivotally attached to said housing such that said flattener plate can fit flush against said front plate of said housing;

means for crimping the middle of a can mounted to the top of said flattener plate within said housing;

a captive plate fixedly mounted in a spaced relationship to said flattener plate, said captive plate being in a position parallel to and facing said flattener plate;

said captive plate and said flattener plate thereby defining an area therebetween in which said rollers of said arms are positioned;

an electric motor for rotating said pivot rod;

a tray feeder attached to said can flattening apparatus, said tray feeder being adapted to hold and guide cans in an ordered fashion into said entrance opening of said housing.

* * * * *